US012448783B2

(12) United States Patent
Zemora et al.

(10) Patent No.: US 12,448,783 B2
(45) Date of Patent: Oct. 21, 2025

(54) TILE PANEL ASSEMBLY AND METHOD OF MANUFACTURE

(71) Applicants: Daniel Zemora, Chilliwack (CA); Jonathan Zemora, Chilliwack (CA); Nicolae Zemora, Chilliwack (CA); Cornelius Berbec, Chilliwack (CA)

(72) Inventors: Daniel Zemora, Chilliwack (CA); Jonathan Zemora, Chilliwack (CA); Nicolae Zemora, Chilliwack (CA); Cornelius Berbec, Chilliwack (CA)

( * ) Notice: Subject to any disclaimer, the term of this patent is extended or adjusted under 35 U.S.C. 154(b) by 0 days.

(21) Appl. No.: 18/060,620

(22) Filed: Dec. 1, 2022

(65) Prior Publication Data

US 2024/0183170 A1 Jun. 6, 2024

(51) Int. Cl.
*E04F 13/08* (2006.01)

(52) U.S. Cl.
CPC ..... *E04F 13/0885* (2013.01); *E04F 13/0871* (2013.01)

(58) Field of Classification Search
CPC ..... E04F 13/0885; E04F 13/0871
See application file for complete search history.

(56) References Cited

U.S. PATENT DOCUMENTS 9,297,167 B1 * 3/2016 Stockton ..... E04F 13/142

OTHER PUBLICATIONS

Bath Fitter—How it works. Youtube video Apr. 21, 2021 https://www.youtube.com/watch?v=aocgG46bY-U (Year: 2021).*

* cited by examiner

*Primary Examiner* — Patrick J Maestri
(74) *Attorney, Agent, or Firm* — Orin Del Vecchio

(57) ABSTRACT

A method of constructing a tile assembly panel wherein the tile assembly panel is constructed at a location different than that of the installed location of the tile assembly panel. The tile assembly panel includes a plurality of tile members wherein the tile members can be any shape, size and type of tile. The tile members during construction of the tile assembly panel have epoxy grout applied to the lateral edges thereof wherein the lateral edges of the tile members are adjacent other lateral edges of adjacent tile members. The method of the present invention employs a horizontal work surface that is flat and rigid facilitating the ability to place the tile members in the correct location and pattern while securing each tile member to every adjacent tile member. Ensuing construction of the tile assembly panel the tile assembly panel is transported to the installation location for install thereof.

6 Claims, 4 Drawing Sheets

TILE PANEL ASSEMBLY AND METHOD OF MANUFACTURE

FIELD OF INVENTION

The present invention relates generally to construction methods and techniques, more specifically but not by way of limitation, a tile assembly that is assembled off site from a construction project, wherein the present invention employs utilization of epoxy grout and other elements such as but not limited to metal edge members and wherein the tile assembly is shipped to the job site for installation.

BACKGROUND

Both commercial and residential structures utilize many different types of flooring material that is selected both for the application as well as the area of the structure. One of the most commonly utilized flooring materials is tile. Tile is typically provided in either a ceramic or porcelain version and conventionally available tiles can range in size from four square inches to several square feet. Regardless of the type of tile that is to be installed, the installation process is similar for most types of tile. Most often there is a backerboard that is installed first in the area that is to have tile applied thereto. The backer board is typically mechanically fastened to a subfloor or wall and the seams thereof are often grouted to ensure a smooth surface. The next step for tile installation is to mix a mortar wherein the mortar is applied to the backerboard and the tiles are then set in the mortar in the desired pattern. The laying and setting of tiles can often take a significant amount of time as spacers are typically utilized to ensure the proper spacing between the tiles.

Subsequent laying of the tiles, the mortar must be allowed to dry. After the mortar has dried, the grout will be applied which involves mixing of the grout which is typically a sanded or non-sanded product that is operable to fill the void between the adjacent tiles. The grout application will consume time not only for the mixing and application thereof but the careful cleaning of the area ensuing application of the grout. All of the aforementioned steps are time consuming and require a significant amount of labor hours as well as supervision to ensure proper installation. The traditional method of tile application can be cost prohibitive when combined with the raw material costs for some application.

It is intended within the scope of the present invention to provide a tile assembly that comprises of a preassembled tile portion comprised of a plurality of tiles wherein the preassembled tile portion is assembled offsite and requires significantly less labor hours and materials.

SUMMARY OF THE INVENTION

It is the object of the present invention to provide a method for assembling a plurality of tiles off site from the installation location wherein the present invention includes utilization of tiles of various types, sizes and shapes.

Another object of the present invention is to provide a tile assembly that is manufactured off site comprising of a plurality of tiles wherein the tile assembly can be provided in alternate sizes and shapes.

A further object of the present invention is to provide a method for assembling a plurality of tiles off site from the installation location wherein the method of the present invention includes utilization of epoxy grout.

Still another object of the present invention is to provide a tile assembly that is manufactured off site comprising of a plurality of tiles wherein the epoxy grout is intermediate each of the adjacent tiles and further is present on the rear side of the tiles adjacent to the seams of neighboring tiles.

An additional object of the present invention is to provide a method for assembling a plurality of tiles off site from the installation location wherein the tile assembly is prefabricated on a suitable horizontal support surface.

Yet a further object of the present invention is to provide a tile assembly that is manufactured off site comprising of a plurality of tiles wherein the tile assembly can be configured to have grooves in the rear side of the tiles wherein a support rod member can be secured therein.

Another object of the present invention is to a provide a method for assembling a plurality of tiles off site from the installation location wherein the tile assembly of the present invention is lightweight.

An alternate object of the present invention is to provide a tile assembly that is manufactured off site comprising of a plurality of tiles wherein adjacent tile assembly panels can incorporate metal edges therebetween.

Still a further object of the present invention is to provide a method for assembling a plurality of tiles off site from the installation location wherein the method of the present invention includes installation of a tile assembly panel at a job site.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
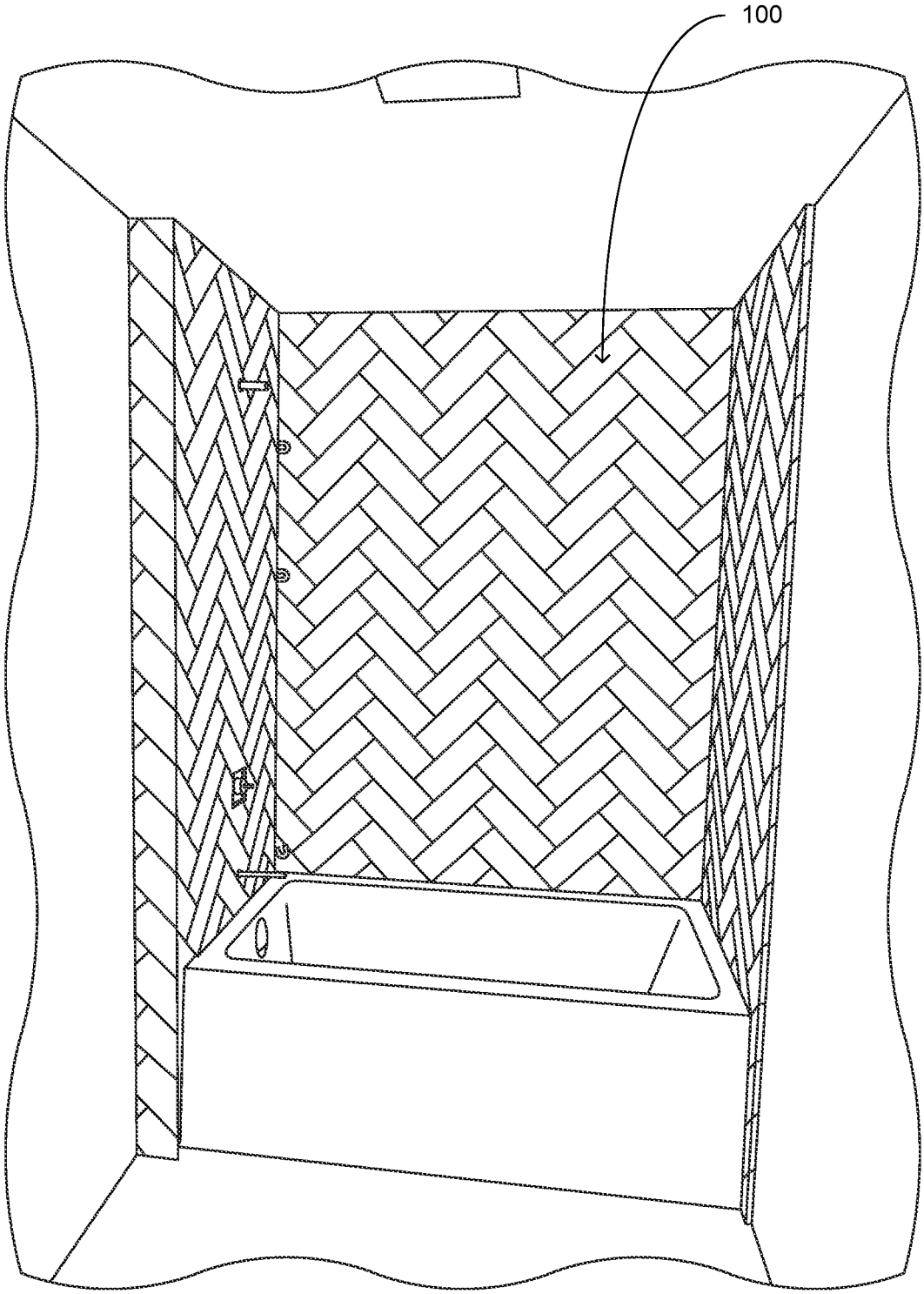
FIG. 1 is an exemplary installation of a plurality of tile assembly panels of the present invention.
Figure 2:
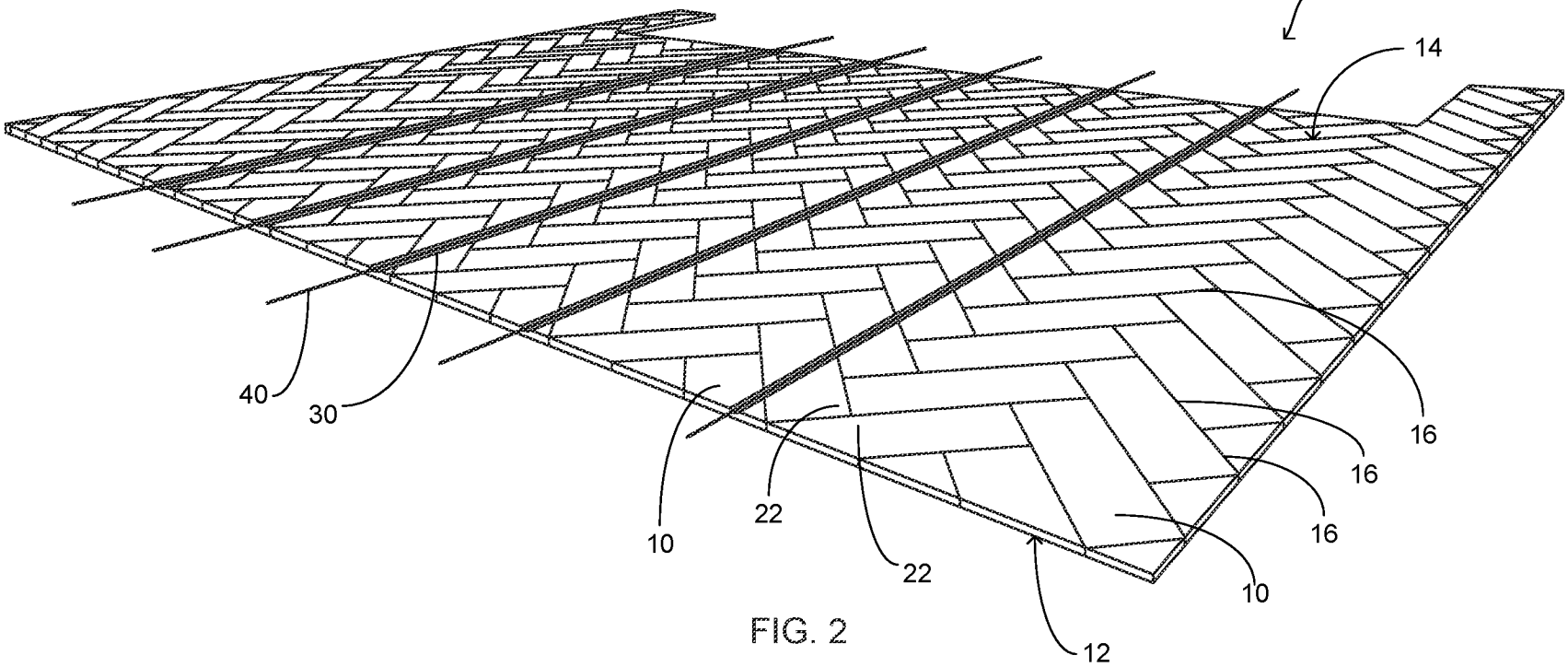
FIG. 2 is a rear surface view of an exemplary tile assembly panel of the present invention.

Referring now to the drawings submitted herewith, wherein various elements depicted therein are not necessarily drawn to scale and wherein through the views and figures like elements are referenced with identical reference numerals, there is illustrated a tile assembly panel 100 constructed according to the principles and method of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the tile assembly panel 100 is illustrated herein in Figure and it should be understood within the scope of the present invention that the illustrated shape of the tile assembly panel 100 herein is exemplary. It is contemplated within the scope of the present invention that the tile assembly panel 100 could be manufactured employing the method of the present invention in numerous alternate shapes and sizes. Furthermore, the arrangement pattern of the tile members 10 illustrated herein is exemplary only and it should be understood within the scope of the present invention that the tile members 10 could be arranged in various different patterns and further employ tile members 10 of different shapes and sizes.

The tile assembly panel 100 includes a plurality of tile members 10 placed adjacent to each other. The tile assembly panel 100 includes a front surface 12 and a rear surface 14. The front surface 12 of the tile assembly panel 100 is the finished material surface while the rear surface 14 is unfinished. The edges 16 of the tile members 10 have applied thereto an epoxy grout during assembly process of the tile assembly panel 100 as is further discussed herein. During application of the epoxy grout to the edges 16 of the tile member 10 an amount of the epoxy grout is applied to the rear surface 14, in particular the tile member border area 22, of the tile assembly panel 100 immediately adjacent the edges 16 of the tile members 10. Application of the epoxy grout to the tile member border area 22, provides additional rigidity for the overall tile assembly panel 100 and assists in maintaining the structural integrity thereof during transport. The edges 60 of the tile assembly panel 100 can further include elements such as but not limited to a metal edge member for waterproofing and/or structural integrity.

The tile assembly panel 100 can further include grooves 30 wherein the grooves 30 have support rod members 40 secured therein. The grooves 30 are formed in the rear surface 14 of the tile assembly panel 100 utilizing suitable durable techniques. It should be understood within the scope of the present invention that the grooves 30 could extend partially or completely across the tile assembly panel 100 in various directions. The support rod members 40 are manufactured from lightweight rigid material and function to enhance the structural integrity of the tile assembly panel 100. It should be understood within the scope of the present invention that the support rod members 40 could be provided in alternate diameters and would not extend outward from the groove 30 so as to project past the rear surface 14. Furthermore, it should be understood within the scope of the present invention that the tile assembly panel 100 could be manufactured by the method of the present invention without the support rod members 40.

Figure 3:
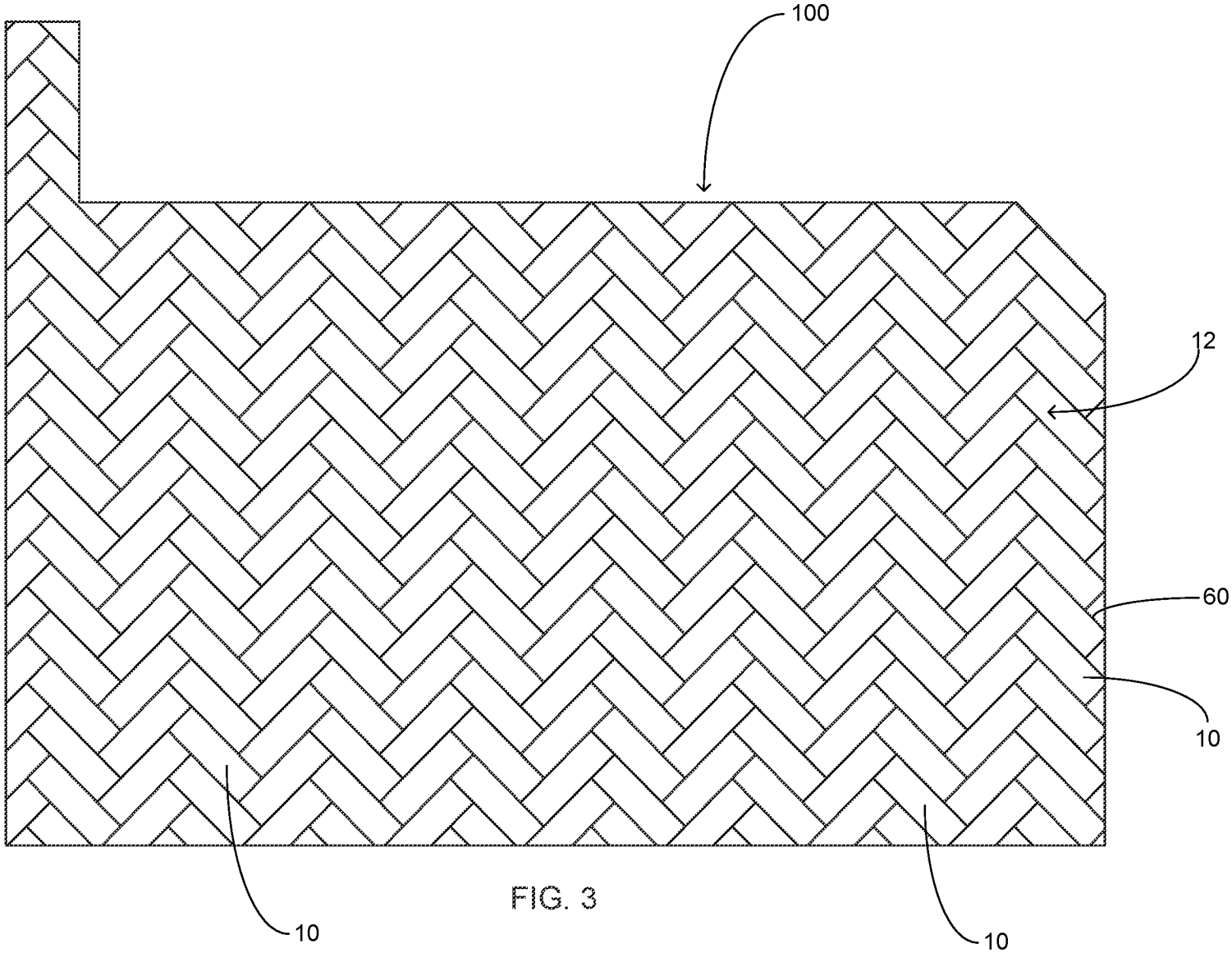
FIG. 3 is a front surface view of an exemplary tile assembly panel of the present invention.
Figure 4:
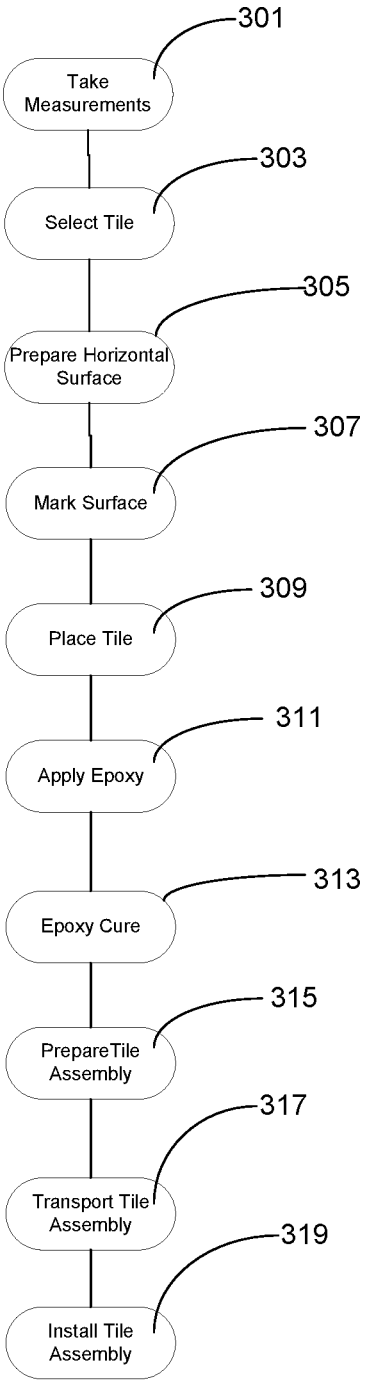
FIG. 4 is a flowchart of the method of the present invention.

Now referring to FIG. 3 submitted herewith the method of manufacturing the tile assembly panel 100 is outlined therein. In step 301, measurements of the area to have the tile assembly panel 100 placed thereon are obtained. Step 303, a tile size, type and pattern are selected. In step 305, a suitable horizontal surface is prepared to commence construction of the tile assembly panel 100. It is contemplated within the scope of the present invention that a large steel table top or other suitable flat rigid surface could be employed as the horizontal surface for use during construction of the tile assembly panel 100. Step 307, if desired, a user can mark indicia on the horizontal surface wherein the indicia indicates the size and shape of the tile assembly panel 100 to be constructed. In step 309, the user will initiate the placement of the tile members 10 in the desired pattern. Step 311 commences simultaneously with step 309 wherein the user will place epoxy grout on all of the edges 16 of the tile members 10 that have an adjacent tile member thereto. Step 309 will further include placement and securing of any edge members. An amount of the epoxy grout is further applied to the tile border area 22. In step 313, the epoxy grout is provided the required time to cure. Step 315, the assembled tile assembly panel 100 is prepared for transportation. In step 317, the tile assembly panel 100 is transported to the location for installation. Step 319, the tile assembly panel 100 is installed in the appropriate area for which the tile assembly panel 100 has been constructed wherein the installation of the tile assembly panel 100 can employ various alternate chemical adhesives to secure the tile assembly panel 100 in position.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A method of constructing a tile panel wherein the tile panel is constructed at a first location and installed at a second location wherein the method comprises the steps of:

taking measurements of an area for which tile is desired to be applied;

selecting a tile type and size;

preparing a horizontal surface for construction of the tile panel, wherein the horizontal surface is at the first location;

marking the horizontal surface, wherein the horizontal surface has indicia placed thereon indicating a size and shape of the tile panel;

placing tile members on the horizontal surface, wherein tile members are placed on the horizontal surface as indicated by the indicia thereon;

applying an epoxy grout to each of the tile members, wherein lateral edges of each of the tile members have the epoxy grout applied thereto immediately prior to placement of each tile member;

curing the epoxy grout, wherein the epoxy grout is provided time to cure ensuing completion of construction of the tile panel;

transporting the tile panel to the second location; and installing the tile panel at the second location.

2. The method of constructing a tile panel as recited in claim 1, wherein the tile panel further includes a front surface and a rear surface, said rear surface having grooves formed therein, said grooves extending intermediate lateral edges of said tile panel.

3. The method of constructing a tile panel as recited in claim 2, wherein the tile panel further includes support rod members, said support rod members being secured within said grooves.

4. The method of constructing a tile panel as recited in claim 3, and further including the step of applying an amount of epoxy grout to a tile border area, said tile border area being present on each tile member and adjacent to lateral edges thereof.

5. The method of constructing a tile panel as recited in claim 4, wherein the tile panel further includes lateral edges, said lateral edges having a metal edge member secured thereto.

6. The method of constructing a tile panel as recited in claim 5, wherein the tile panel is adhered in position at the second location employing chemical adhesives.

* * * * *